United States Patent [19]

Rogers

[11] Patent Number: 4,669,228

[45] Date of Patent: Jun. 2, 1987

[54] TIRE UNIFORMITY ABRADING METHOD

[75] Inventor: Clarence L. Rogers, Hartville, Ohio

[73] Assignee: The Uniroyal Goodrich Tire Company, Akron, Ohio

[21] Appl. No.: 795,000

[22] Filed: Nov. 4, 1985

[51] Int. Cl.[4] ..... B24B 1/00

[52] U.S. Cl. ..... 51/281 R; 51/106 R; 51/165 R; 51/165.92

[58] Field of Search ..... 51/106 R, 165 R, 281 R, 51/289, 165.92

[56] References Cited

U.S. PATENT DOCUMENTS

| | | | |
|---|---|---|---|
| 3,553,903 | 1/1971 | Christie | 51/106 R |
| 3,574,973 | 4/1971 | Rader | 51/165 |
| 3,725,163 | 4/1973 | Hofelt, Jr. | 156/64 |
| 3,817,003 | 6/1974 | Monajjem | 51/165 R |
| 4,041,647 | 8/1977 | Ugo | 51/165 R |
| 4,458,451 | 7/1984 | Rogers et al. | 51/165 R |

*Primary Examiner*—Harold D. Whitehead

*Attorney, Agent, or Firm*—Harry F. Pepper, Jr.

[57] ABSTRACT

An apparatus for reducing radial force variations of pneumatic tires by removing rubber in selected areas of the shoulders wherein the current generated by each grinder motor is detected, converted into DC voltages of opposite polarities which are summed with a resultant voltage shown on a meter. When the resultant voltage differs from a predetermined level, usually zero, the grinding wheels can be adjusted thereby balancing the amount of grinding performed on the shoulders of the tire.

2 Claims, 4 Drawing Figures

GRINDER CURRENT AMPERES

TIRE UNIFORMITY ABRADING METHOD

BACKGROUND OF THE INVENTION

This invention relates to pneumatic tires and particularly to the processing of the tire to assure dynamic uniformity of the tire. More particularly, the invention relates to an apparatus for reducing radial force variations of the tire.

In pneumatic tires, components such as beads, inner liner, tread and sheets or plies of rubberized cords utilized in the carcass of the belts are segmentally assembled. Such assemblage can result in a structural nonuniformity in pneumatic tires which cause radial force variations when the tire is rotated along a surface, such as a roadway. Radial force variations are those defects which result from "hard" and/or "soft" spots in the tire due to structural nonuniformities such as inconsistent wall thickness, ply arrangement and other deviations. When the radial force variations exceed an acceptable level, the ride of the vehicle can be adversely affected.

The above-described radial force variations are generally corrected on a tire uniformity correction machine, described, for example, in U.S. Pat. Nos. 3,574,973; 3,725,163 and 4,458,451, wherein the radial force variations are detected, measured and selected portions of tread rubber are removed by a pair of grinders, one located at each shoulder of the tire which effects a reduction in radial force variations.

In existing tire uniformity correction machines, a tire is mounted on a rotatable axle wherein the tire is inflated and rotated against a loadwheel. Radial force variations transmitted to the loadwheel are sensed by transducers, such as load cells wherefrom electrical signals representing the actual measured radial force variations are generated and sent to a computer. The signals are sorted and compared to predetermined lower and upper limits of correctable radial force variations wherein the computer makes a grind or no-grind decision by comparing the actual measured radial force variations to the lower and upper limits. If the measured radial force variations do not exceed the lower limit, no grinding is performed. If the measured radial force variations exceed the upper limit of radial force variations wherein the radial force variations cannot be corrected without excess removal of rubber, no grinding is done and the tire is also removed from the machine.

Grind instructions typically are generated when the measured radial force variations exceed the lower limit and are less than the upper limit. A pair of hydraulic cylinders are actuated wherein each hydraulic cylinder moves a corresponding rotary grinder to the shoulder of the tire. The rotary grinders remove material from selected areas of the shoulders to reduce the radial force variations to the acceptable limit.

The depth of grinding performed on the selected areas of the shoulders is dependent on the grind instruction generated by the computer and the preset position of the grinders relative to the shoulders of the tire. The preset position is generally referred to as the skim position wherein each grinding wheel is set to a reference location at a predetermined distance from the tire surface. The skim position of each grinding wheel can be altered by a mechanical adjustment of a shroud which supports the grinding wheel. However, the skim position of each grinding wheel is dependent on operator judgment as to the adjustment and the amount of contact between the grinding wheel and the shoulder of the tire.

It has been found the skim position of the pair of shoulder grinders can differ due to operator judgment error which can result in one grinder removing more rubber from one shoulder than is removed from the other shoulder. When more rubber is removed by one grinder, excessive force may be exerted on the tire resulting in an appearance blemish due to the tearing and ripping of the rubber across the selected area of grinding. When removal of large amounts of rubber is required to remove radial force variations, mispositioning of the grinders can result in one grinder grinding too far into the tire resulting in a blemished tire. In either case, the positioning of the grinders is generally not detected until a tire is blemished. A device and method is needed to detect, measure and compare the amount of grinding done by the pair of grinders in order to achieve an improved grinding of the tire and reduce the possibility of blemishing a tire.

The difference in the skim position settings of a pair of grinders can result in lower grind margins for a given tire. For example, if a tire is ground from 50 pounds peak-to-peak to 30 pounds peak-to-peak without blemishing the tire, the grind margin is 20 pounds. An increase in the grind margin would allow tires with higher radial force variations to be ground out without adversely affecting the tire. If the grinders are set at different skim positions, the grind margin of the "heavier" ground shoulder of the tire fixes the maximum force removable without blemishing the tire.

One way to measure the amount of grinding done by each grinder is to measure the amount of current used by the electric motor which operates the grinder. The current used by the motor can be monitored by an ammeter. However, the current utilized by each grinder motor is not only dependent on the grinding of the tire but also is dependent on the condition of the motor and other variable effects.

It is desirable to reduce the difference in the skim position settings of a pair of grinders in order to improve the uniformity of grinding of tires and to reduce blemishing of the tires.

SUMMARY OF THE INVENTION

It is an object of the present invention to provide an improved method for reducing radial force variations in pneumatic tires.

The object and other objects and advantages are achieved by the method of the present invention wherein a pneumatic tire is rotated against a loadwheel and radial force variations of the tire are detected and measured by a means such as transducers. The magnitude of the measured radial force variations is compared with a predetermined range. A signal is sent to a pair of grinders wherein the grinders grind the shoulders of the tire. Each grinder includes an electrical motor.

The method of the present invention further includes a circuit device to detect current used by each motor and convert the current to a secondary current. The circuit device includes means to convert the secondary current of one electrical motor to a positive DC current and a means to convert the secondary current of the second electrical motor to a negative DC current. The positive DC current and negative DC current are passed through a resistor producing a negative voltage and positive voltage. The sum of the voltages is indicated by a meter.

The method of the present invention to reduce radial force variations enables an operator to monitor the grinding allowing the operator to make adjustments to reduce the possibility of blemishing tires.

DETAILED DESCRIPTION OF THE INVENTION

Figure 1:
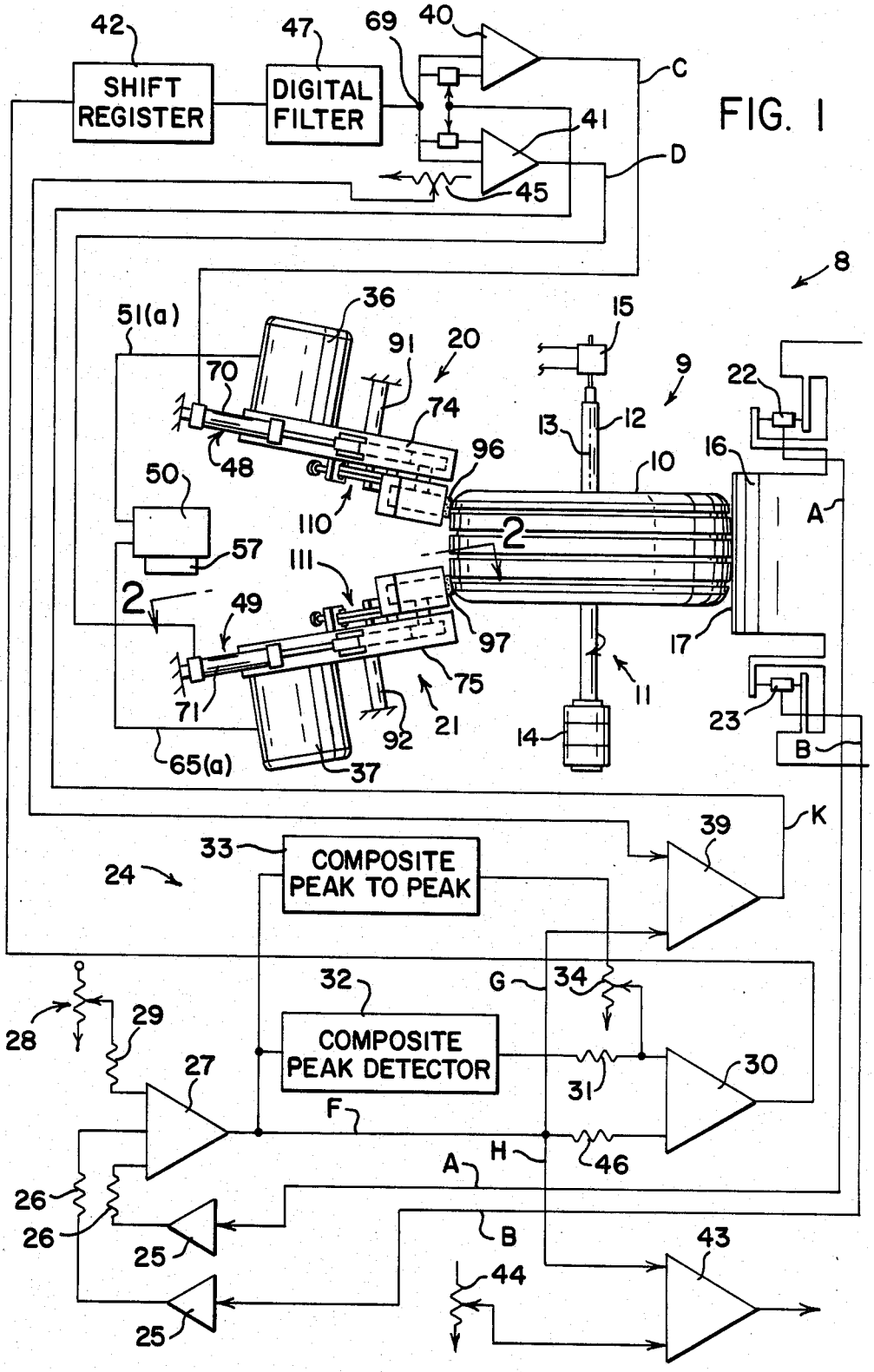
FIG. 1 is a schematic diagram illustrating a tire uniformity correction machine for detecting, measuring and reducing radial force variations in a pneumatic tire.

In FIG. 1 there is shown by schematic representation a tire uniformity apparatus 8 which operates to reduce radial force variations of a pneumatic tire 10. The tire uniformity apparatus 8 includes a means 9 to detect and measure radial force variations, two grinders 20, 21, a computer 24, a meter 57, and a circuit means 50. The two grinders 20, 21 are referred to as an upper grinder 20 and a lower grinder 21 based on their proximity to the shoulders of the tire 10.

The means 9 to detect and measure radial force variations of the tire 10 includes load cells 22, 23, a load wheel 16, and a rotating device 11 which includes a chuck (not shown) upon which the tire 10 is rotatably mounted. The chuck is attached by suitable means to a spindle 12 which is rotated by a motor 14 or other suitable rotary drive about an axis of rotation 13. Rotation of the tire 10 can be in either a clockwise or counterclockwise direction. The motor 14 is generally a regular AC constant speed motor which operates the spindle at about 60 rpm. Suitably attached to the spindle 12 is a position encoder 15. The tire 10 is pneumatically inflated to a predetermined test pressure.

Positioned adjacent to the tire 10 is the loadwheel 16 which has a cylindrical surface 17. The loadwheel 16 is adapted for free rotation about a non-rotating axle (not shown) spaced from but parallel with the axis of rotation 13 of the axle 12. The axle upon which the loadwheel 16 rotates is adjustably mounted so that the loadwheel 16 may be positioned closer to or further from the axis of rotation 13 of the tire 10. In this manner, a predetermined deflecting load may be set up against the tire 10 by the surface 17 of the loadwheel 16.

Operatively coupled to the loadwheel 16 are the two load cells 22, 23 which contain sensors such as strain gauges which measure the force exerted on the loadwheel 16 in the radial directions by the rotating tire 10 and convert the radial force variations measurements to an electrical signal such as voltage level signals which are fed to a computer 24 via lines A and B.

The input signals from lines A and B into the computer 24 pass through instrumental amplifiers 25 and series resistors 26 prior to being fed to a summer amplifier 27. In addition to the inputs from lines A and B, the summer amplifier 27 receives a predetermined tire load signal from a load potentiometer 28 which is passed through a resistor 29 into the summer amplifier 27.

The output from the summer amplifier 27 creates a composite signal, which in the composite mode passes directly through one line F through a series resistor 46 to a grind comparator amplifier 30. The composite signal also passes to a grind classifier 39 through line G and a scrap classifier 43 through line H. A scrap limit potentiometer 44 provides a preselected value for a maximum limit detection so that if the composite signal exceeds the preselected value then no grinding will occur and the tire will be transferred from the tire uniformity machine 8. The grind classifier 39 compares the composite signal with a voltage from a grind limit potentiometer 45 and this determines whether additional grinding is required. If no additional grinding is required, the signal of line K effects retraction of the grinders.

The composite signal from the summer amplifier 27 passes through a composite peak detector 32, and a resistor 31 to the grind comparator amplifier 30 and the composite signal passes through a composite peak-to-peak detector 33, to a constant angle adjustment potentiometer 34 before summing with the output of the composite peak detector 32 at the grind comparator amplifier 30. The action of the constant angle potentiometer 34 in the composite mode is to position the grind reference level to one spot of the tire, called the hard spot, at one end of the potentiometer wherein the grinding wheels will not be positioned against the tire at any point on the 360° circumference of the tire 10. When the constant angle potentiometer 34 is positioned at the other end of the potentiometer, the grind reference level is referenced to the soft spot of the tire which is 180° opposite to the hard spot, and grinding will occur on the complete 360° circumference of the tire.

The grind comparator 30 compares the direct output from the summer amplifier 27 with the combined output from the composite peak detector 32 and composite peak-to-peak detector 33, wherein the combined output is called the comparator reference signal. A grind signal is issued whenever the direct composite signal exceeds the comparator reference signal and does not exceed the maximum limit of the scrap limit potentiometer 44. It is recognized the radial composite mode of measuring radial force variations, as described can be replaced by radial harmonic mode of measuring radial force variations in the present invention.

Figure 2:
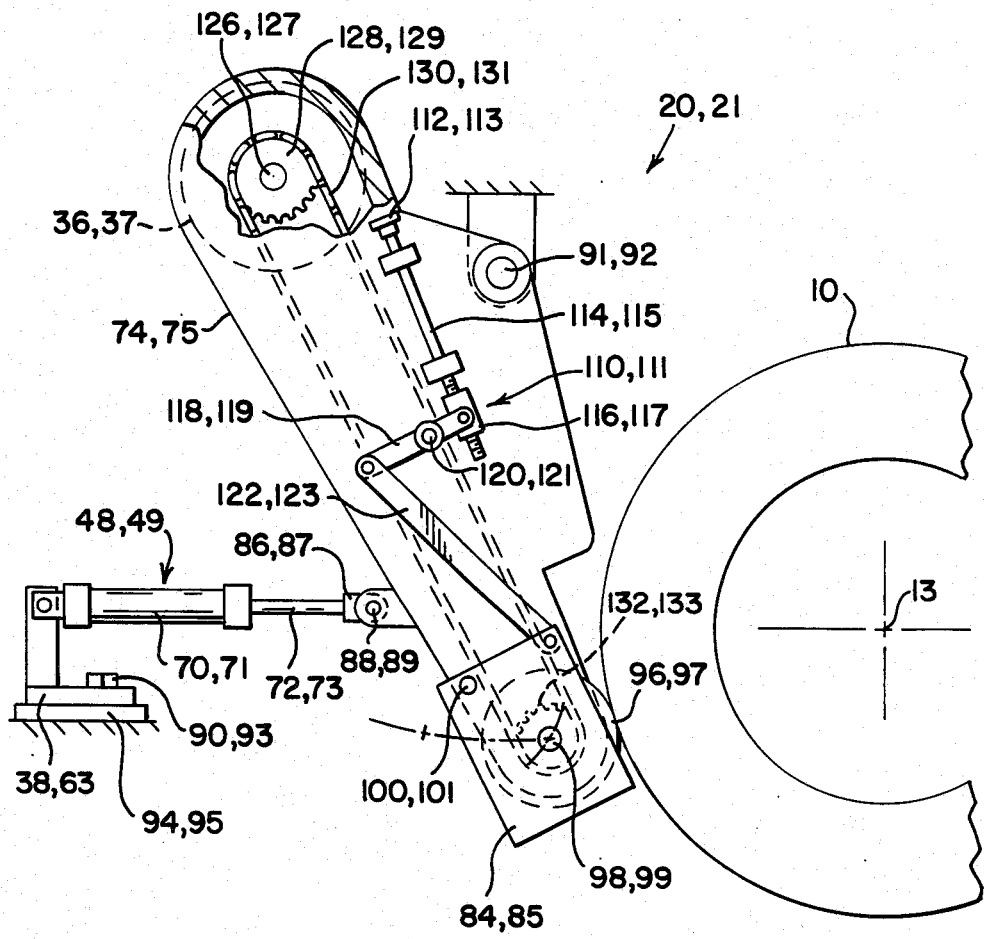
FIG. 2 is a top view taken along the line 2—2 in FIG. 1 illustrating a grinding device used in the present invention.

The grind signal from the computer 24 is sent through a shift register 42, a digital filter 47 to a nodal point 69 wherein the signal is divided into two signals. Each of the signals passes through a servo amplifier 40, 41 wherein the signal is converted to a pneumatic signal which is passed through lines C, D to the two grinders 20, 21. As shown in FIGS. 1 and 2, the two grinders 20, 21 include frames 74, 75 which support electric motors 36, 37, hydraulic systems 48, 49 and adjustable grinding shrouds 84, 85. The frames 74, 75 are pivotably mounted on the apparatus 8 with pins 91, 92 or other suitable devices to allow for each grinder 20, 21 to pivot towards or away from the shoulder of the tire 10.

Attached to the frame 74, 75 are hydraulic systems 48, 49 which includes cylinders 70, 71, rods 72, 73 and cleavis 86, 87 which are attached to the frames 74, 75 by pins 88, 89, or other suitable means. Mounted on one end of the cylinder 70, 71 is a bracket 38, 63 which is secured by bolts 90, 93 or other suitable means to a bracket 94, 95 attached to the apparatus 8.

The two grinders 20, 21 further include grinding wheels 96, 97 rotatably mounted on a shaft 98, 99 which are journaled into the shrouds 84, 85. The shrouds 84, 85 pivot about a pin 100, 101 which allows for adjustment of the closeness of the grinding wheels 96, 97 to the tire 10. Oliver SSG230 coarse tooth grind wheels are preferably used for the grinding wheels 96, 97 in the present invention.

The position of the adjustable grinding shroud can be manually adjusted by an operator by adjustment linkage 110, 111 which includes a knob 112, 113, a rod 114, 115 which is connected by suitable means to the knob 112, 113 and has an expanded threaded end **114(*a*), 115(*a*) which is fitted to a threaded control device 116, 117, an intermediary arm 118, 119 which is connected to a ball 120, 121 and a connecting arm 122, 123 connected to the grinding shroud 84, 85. Adjustment of the knob 112, 113 results in the grinding wheel 96, 97 moving closer to the shoulder or further from the shoulder of the tire 10 and in particular the adjustment linkages 110, 111 are used to set the skim position of the grinding wheels 96, 97** to the corresponding shoulders of the tire.

Rotation of the grinding wheel 96, 97 is effected through a shaft 126, 127 driven by the motor 36, 37. The motor 36, 37 output causes rotation of an output shaft 126, 127 which is connected to a sprocket 128, 129. Rotation of the sprocket 128, 129 is transmitted through a chain 130, 131 or other suitable drive means to a sprocket 132, 133 attached to the shaft 98, 99 and secured by a key or other suitable means.

Signals from the position encoder 15 control the operation and timing of the shift register 42 to insure that grind locations on the tire 10 are appropriately delayed such that action of the hydraulic systems 48, 49 are related to these grind locations on the tire 10 as they are brought into position by rotation of the tire 10 on the spindle 12.

Figure 3:
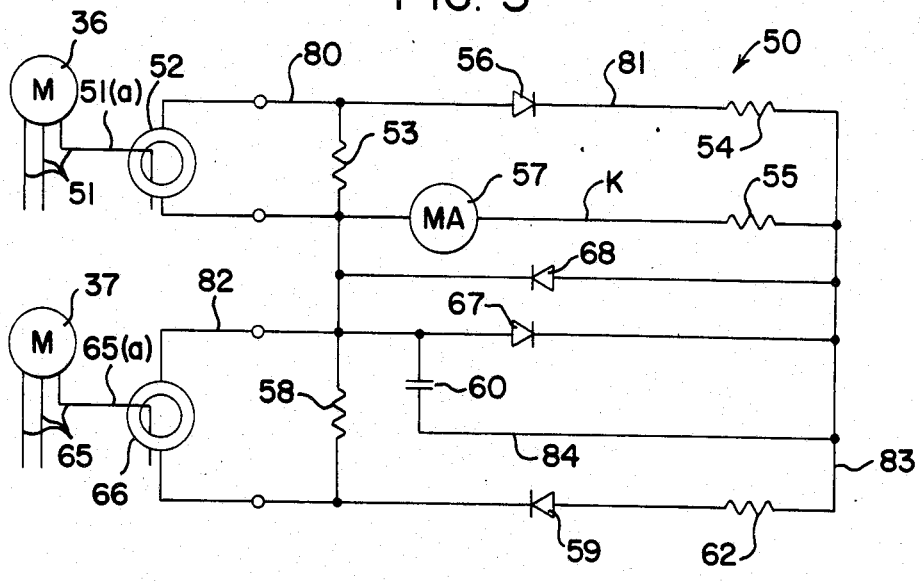
FIG. 3 is a schematic block diagram of the electrical circuit for measuring a resultant current developed from detecting the AC current used by the two grinders.
Figure 4:
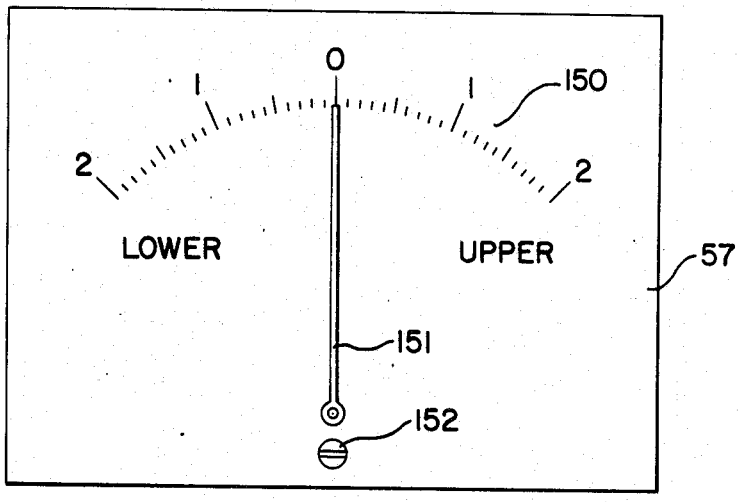
FIG. 4 is a front view of a meter face used in the apparatus.

The electric motors 36, 37 are 3-phase 440 motors wherein each motor 36, 37 has a set of three wires 51, 65 connected to a power source (not shown). One wire **51(*a*), 65(*a*) of each set 51, 65 is associated with the circuit means 50 as shown in FIGS. 1 and 3. In FIGS. 1 and 4 is shown the meter 57** from which an operator can monitor the grinding.

FIG. 3 shows a schematic diagram of the circuit means 50 which measures the resultant DC current derived from the current used by the motor 36 of the upper grinder 20 and the motor 37 of the lower grinder 21. In order to measure the current used by the motor 36, one wire **51(*a*) of the set of wires 51 is passed through a current transformer 52** such as a 2 VA current transformer consisting of 200 turns of #2 wire.

Loop 80 of the circuit means 50 allows the secondary AC current generated from the measurement of the current used by motor 36 to pass through a resistor 53, a 1000 ohm resistor, and back to the current transformer 52 whereas in loop 81, the AC current passes through a diode 56 which converts the AC current to a positive DC current which thereafter passes through resistors 54, 55. When the positive DC current passes through the resistors 54, 55, a positive voltage is formed. In the preferred embodiment, resistor 54 is a 4990 ohms resistor, resistor 55 is a 562 ohms resistor and diode 56 is a Fairchild FD 304 diode. A center mill positioned DC millimeter 57 such as Modutech 1-0-1 8-inch model T8DMA is connected in loop 81.

One wire **65(*a*) of the set of wires 65 connected to the electric motor 37, is passed through a current transformer 66 similar to current transformer 52. The secondary AC current from the transformer 66 passes through a resistor 58 of 1000 ohms as shown in loop 82. The AC current then passes through a Fairchild FD 300 diode 59 which converts the AC current to a negative DC current which thereafter passes through resistor 62 of 4990 ohms in loop 83 and resistor 55 as heretofore described in loop 81. When the negative DC current passes through the resistors 62 and 55, a negative voltage is formed. The positive and negative voltages are combined in the line K between resistor 55 and the meter 57 to form zero voltage or a resultant voltage which is passed to the meter 57 wherein the voltage is converted to a resultant current which is measured and displayed on the face of the meter 57 which includes a scale 150 and a needle 151**.

A 50 ufd 30 VDC capacitor 60 in loop 84 acts as a filter to the current going to the meter 57. In addition, two Fairchild FD300 diodes 67, 68 are positioned in the circuit means 50 to channel excess current generated when the voltage exceeds a predetermined value wherein to prevent the needle of the meter from contacting stop limits of the meter.

In the case when there is no load on either grinder, the positive and negative voltages generated in the circuit means 50 should cancel each other out and the meter should see a resultant current of zero wherein the needle 151 of the meter can be adjusted by an adjustment screw 152 to 0 on the scale 150 as shown in FIG. 4. During each grinding process of the shoulders of a tire, a deviation from 0 will indicate an excess of current being used by one of the grinders showing the grinders which generally results when skim positions are not the same. Upon recognition of this, the grinders can be mechanically adjusted by the adjustment linkages 110, 111 to correct the position of the grinders.

It has been found that the present invention allows for increased grind margins wherein the range of the predetermined lower and upper limits of correctable radial force variations can be increased without resulting in a blemished tire. In particular, it has been found that the grind margins can be increased by about 20% wherein more tires can be corrected for radial force variations.

Although the invention has been described in detail relative to a presently preferred embodiment, it is evident from the description that departures from and modifications to that description can be made within the scope of the invention measured by the claims.

I claim:

1. In a method for reducing radial force variations in a pneumatic tire which comprises rotating the tire against a predetermined load, detecting and measuring the magnitude of the radial force variations of the rotating tire, comparing said magnitude of the radial force variations with a predetermined magnitude, and simultaneously grinding rubber from selected areas of each shoulder of the tire with a separate grinder operated by a separate electric motor, the improvement comprising:

(a) detecting the current used to operate each grinder while grinding each shoulder;

(b) summing and displaying an indication of any inequality in the currents used to operate the grinders; and (c) adjusting the position of one or the other of said grinders relative to a shoulder of the tire to equalize the currents used to operate the grinders.

2. The method of claim 1 wherein the current required to operate one grinder is converted to a positive DC voltage and the current required to operate the other grinder is converted to a negative Dc voltage and said positive and negative DC voltages are summed to reflect any inequality in the currents used to operate the grinders.

* * * * *